US009618306B2

(12) United States Patent
Hultman

(10) Patent No.: US 9,618,306 B2
(45) Date of Patent: Apr. 11, 2017

(54) MUNITION WITH UNEXPLODED ORDNANCE LIMITING

(71) Applicant: Safariland, LLC, Jacksonville, FL (US)

(72) Inventor: John Hultman, Casper, WY (US)

(73) Assignee: Safariland, LLC, Jacksonville, FL (US)

( * ) Notice: Subject to any disclaimer, the term of this patent is extended or adjusted under 35 U.S.C. 154(b) by 0 days.

(21) Appl. No.: 14/878,355

(22) Filed: Oct. 8, 2015

(65) Prior Publication Data

US 2016/0102954 A1 Apr. 14, 2016

Related U.S. Application Data

(60) Provisional application No. 62/061,985, filed on Oct. 9, 2014.

(51) Int. Cl.

| | |
|---|---|
| ***F42B 5/02*** | (2006.01) |
| ***F42B 5/26*** | (2006.01) |
| ***F42B 15/00*** | (2006.01) |
| ***F42B 12/20*** | (2006.01) |
| ***F42B 5/16*** | (2006.01) |
| ***F41A 1/06*** | (2006.01) |

(52) U.S. Cl.

CPC ..... *F42B 15/00* (2013.01); *F41A 1/06* (2013.01); *F42B 5/02* (2013.01); *F42B 5/025* (2013.01); *F42B 5/16* (2013.01); *F42B 5/26* (2013.01); *F42B 12/20* (2013.01)

(58) Field of Classification Search

CPC .... F42B 5/00; F42B 5/02; F42B 5/025; F42B 5/16; F42B 5/26; F42B 15/00; F42B 12/20; F41A 1/06

USPC ..... 102/473, 430, 439, 464, 469, 470

See application file for complete search history.

(56) References Cited

U.S. PATENT DOCUMENTS

| | | | | |
|---|---|---|---|---|
| 667,435 | A * | 2/1901 | Friese-Greene et al. | F42B 5/10 102/375 |
| 3,142,959 | A * | 8/1964 | Klein | F42B 15/36 102/352 |
| 3,283,719 | A * | 11/1966 | Grandy | F42B 5/02 102/443 |
| 4,619,202 | A * | 10/1986 | Romer | F42B 5/02 102/443 |

(Continued)

FOREIGN PATENT DOCUMENTS

| | | | | |
|---|---|---|---|---|
| FR | 2792399 | A1 | 10/2000 | |
| WO | 2013053016 | A1 | 4/2013 | |
| WO | WO 2016057774 | A1 * | 4/2016 | F42B 12/20 |

OTHER PUBLICATIONS

PCT Appln. No. PCT/US2015/054657, International Search Report and Written Opinion dated Nov. 24, 2015.

*Primary Examiner* — James S Bergin

(74) *Attorney, Agent, or Firm* — Kane Kessler, P.C.; Paul E. Szabo

(57) ABSTRACT

A munition includes a projectile and a propellant unit. A propellant insert in the propellant unit has at least two propellant chambers each receiving a respective propellant charge. A primer mechanism is actuatable to ignite all of the propellant charges in the propellant insert. The combustion products of a selected one of the propellant charges are directed to the projectile and the combustion products of the non-selected propellant charges are vented.

12 Claims, 9 Drawing Sheets

(56) References Cited

U.S. PATENT DOCUMENTS

| | | | | | |
|---|---|---|---|---|---|
| 5,880,397 | A | | 3/1999 | Crilly | |
| 6,142,056 | A | * | 11/2000 | Taleyarkhan | B22D 11/148 102/440 |
| 6,502,514 | B1 | * | 1/2003 | Holler | F42C 19/10 102/204 |
| 8,618,455 | B2 | * | 12/2013 | Hultman | F42B 10/48 244/3.1 |
| 9,068,807 | B1 | * | 6/2015 | Thomas | F42B 15/10 102/370 |
| 9,200,876 | B1 | * | 12/2015 | Thomas | F42B 5/02 |
| 9,500,451 | B2 | * | 11/2016 | Hultman | F42B 5/16 |
| 9,534,858 | B2 | * | 1/2017 | Forbes | F41A 1/06 |
| 2015/0159981 | A1 | * | 6/2015 | Forbes | F42B 5/08 89/14.05 |
| 2016/0018201 | A1 | * | 1/2016 | Hultman | F42B 5/16 102/430 |

* cited by examiner

MUNITION WITH UNEXPLODED ORDNANCE LIMITING

RELATED APPLICATION

This application claims priority to, and the benefit of the filing date of, U.S. Provisional Application No. 62/061,985, filed Oct. 9, 2014. This application incorporates by reference all the subject matter of that provisional application.

BACKGROUND OF THE INVENTION

Munitions are typically designed with a specific operational range, and for a single use. The range and usage are designed to deliver the maximum effect without compromising accuracy. This is accomplished by selectively setting the amount of propellant in the shell, or by altering the containment or shell base configuration. In this manner, manufacturers can offer the same round in multiple operational distances. While this broadens the overall product usage, it also forces the end user either to carry a single munition that may be either ineffective or unsafe, or to carry a large number of shells.

The present invention relates to a munition (cartridge) that includes a propellant unit carrying multiple propellant charges of different capacities, thus allowing the munition's payload to be deployed at a selected one of multiple different engagement distances. In such a case, only one propellant charge is actuated to propel the projectile. It is not desirable to leave the remaining propellant charges in the munition as unexploded ordnance ("UXO"). The present invention addresses that issue.

DETAILED DESCRIPTION

Figure 1:
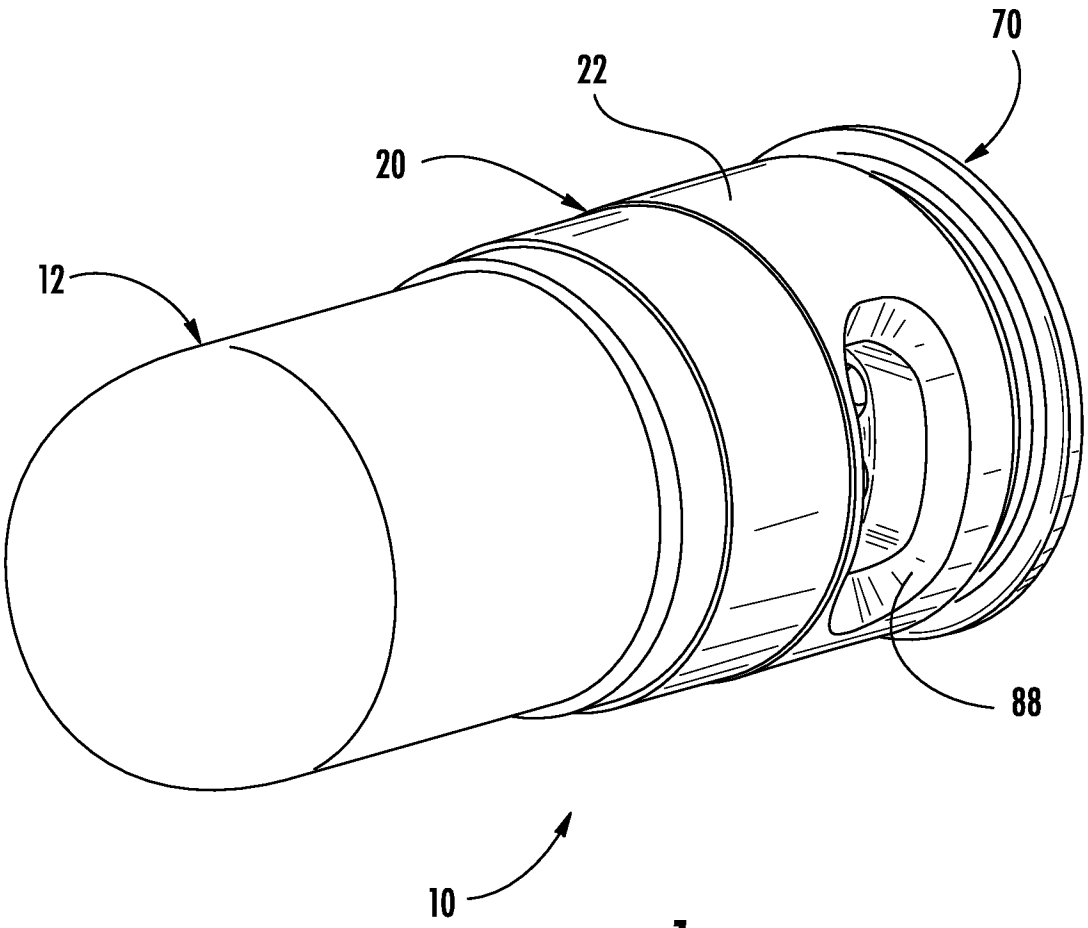
FIG. 1 is an illustration of a munition that is a first embodiment of the invention, including a propellant unit and a projectile.
Figure 2:
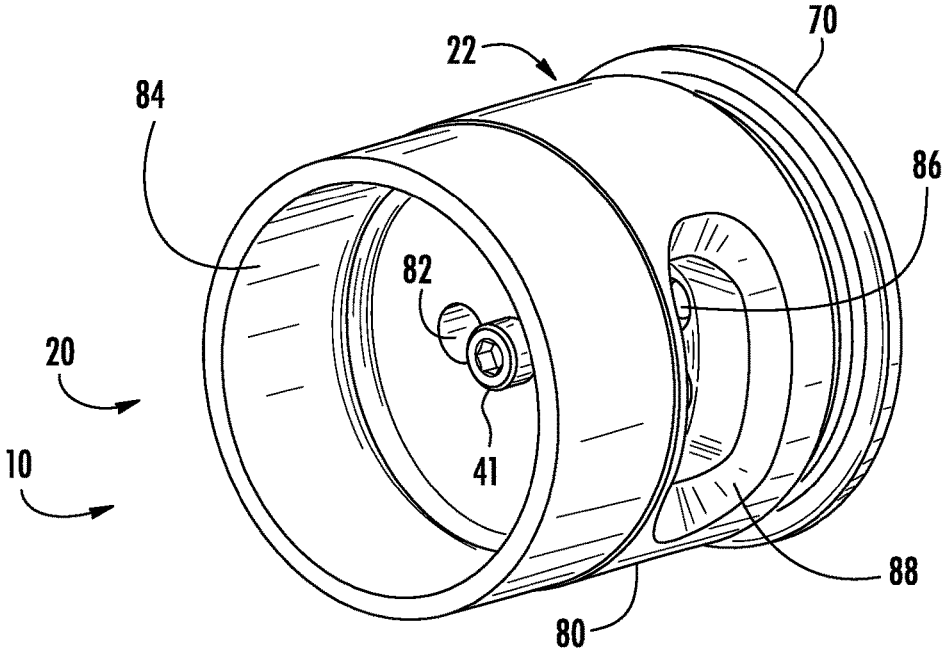
FIG. 2 is a perspective view of the propellant unit of the munition of FIG. 1.
Figure 3:
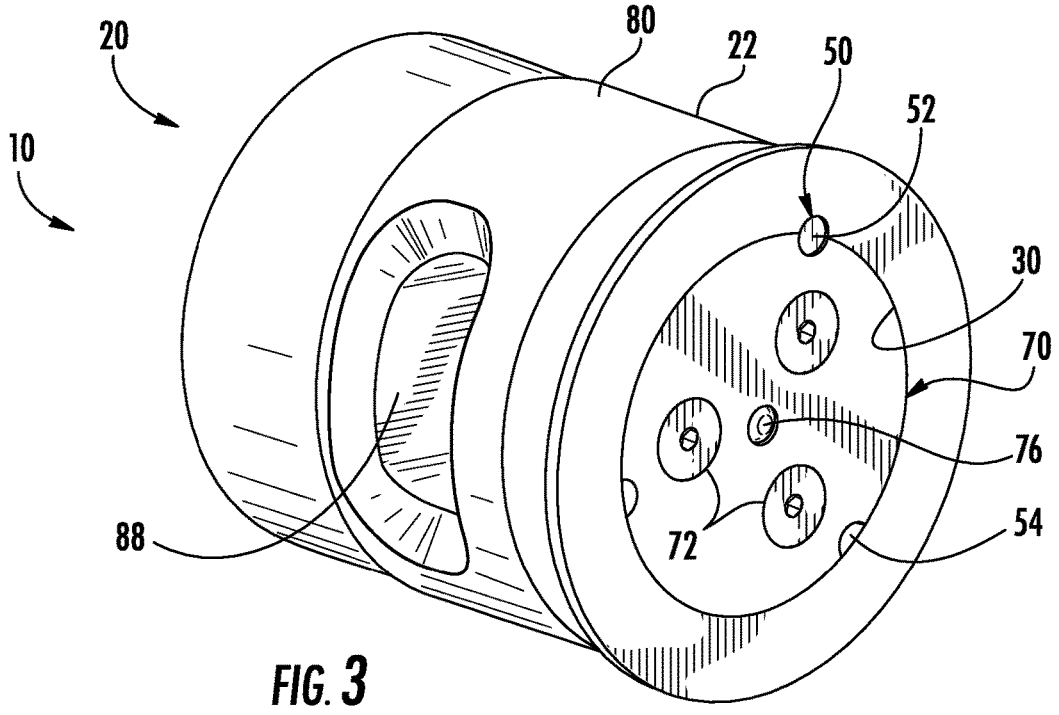
FIG. 3 is another perspective view of the propellant unit.
Figure 4:
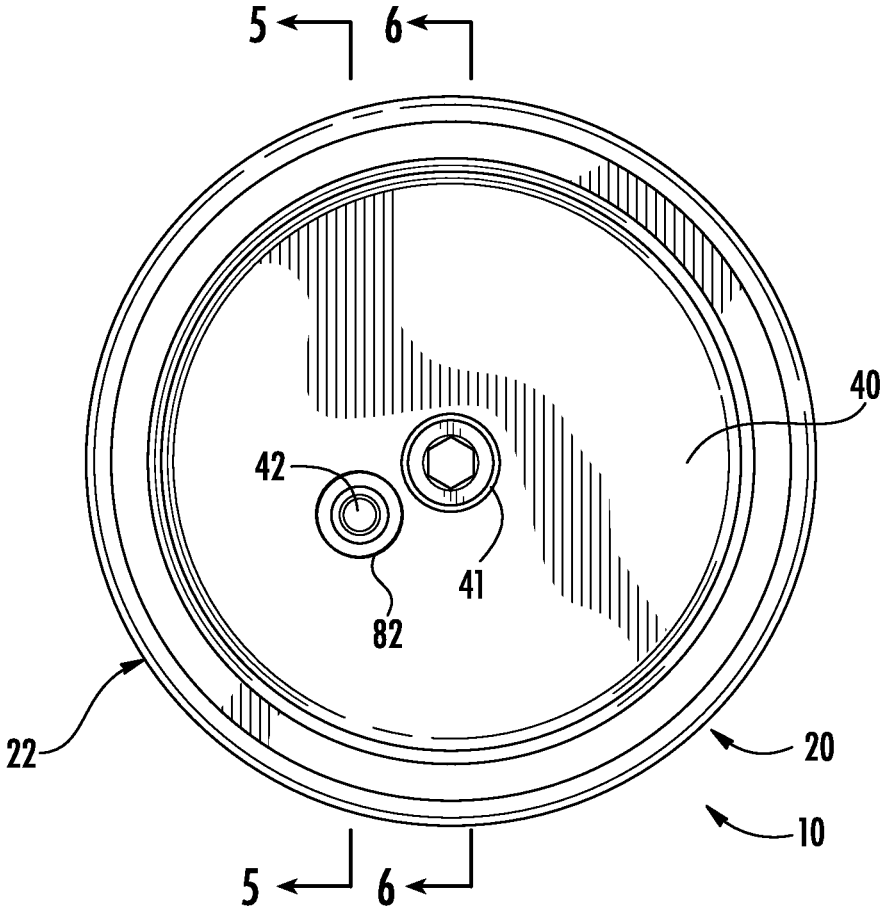
FIG. 4 is an elevational view of the downstream end of the propellant unit.

FIGS. 1-19 illustrate a munition 10 that is a first embodiment of the invention. The munition 10 includes a projectile, shown schematically at 12, that is releasable secured to a propellant unit 20. The propellant unit 20 is actuatable to produce gas under pressure to cause the projectile 12 to release from the propellant unit and travel along the barrel of a launcher (not shown) toward a target. The launcher can be any type of weapon or gun that can launch or project a projectile toward a target. One type of launcher with which a munition of the present invention can be used is the known 40 mm launcher that can launch a projectile containing tear gas or a marking agent, or another type of nonlethal projectile. The launcher has a chamber that receives the munition 10, and a barrel. When the launcher is fired, the propellant unit 20 is actuated, the propellant unit remains in the chamber of the launcher, and the projectile 12 travels along the barrel and exits the barrel to move toward the target.

The propellant unit 20 (FIGS. 2-3) includes a shell base or shell 22. The shell 22 houses or supports the other components of the propellant unit 20. The shell 22 can be made from either plastic or metal, and in calibers ranging from sub-inch to inch-plus. The shell 22 has a cylindrical configuration centered on a longitudinal central axis 24 of the munition 10.

The shell 22 has, at its downstream end (to the right as viewed in FIG. 8) a cylinder opening 30 centered on the axis 24. A cylindrical propellant insert of cylinder 40 is closely fitted in the cylinder opening 30 of the shell 22. The cylinder 40 is rotatable within the cylinder opening 30, about the axis 24. A mechanical fastener 41 is threaded into the downstream end (to the left as viewed in FIG. 8) of the cylinder 40, and holds the cylinder in axial position within the shell 22.

Figure 5:
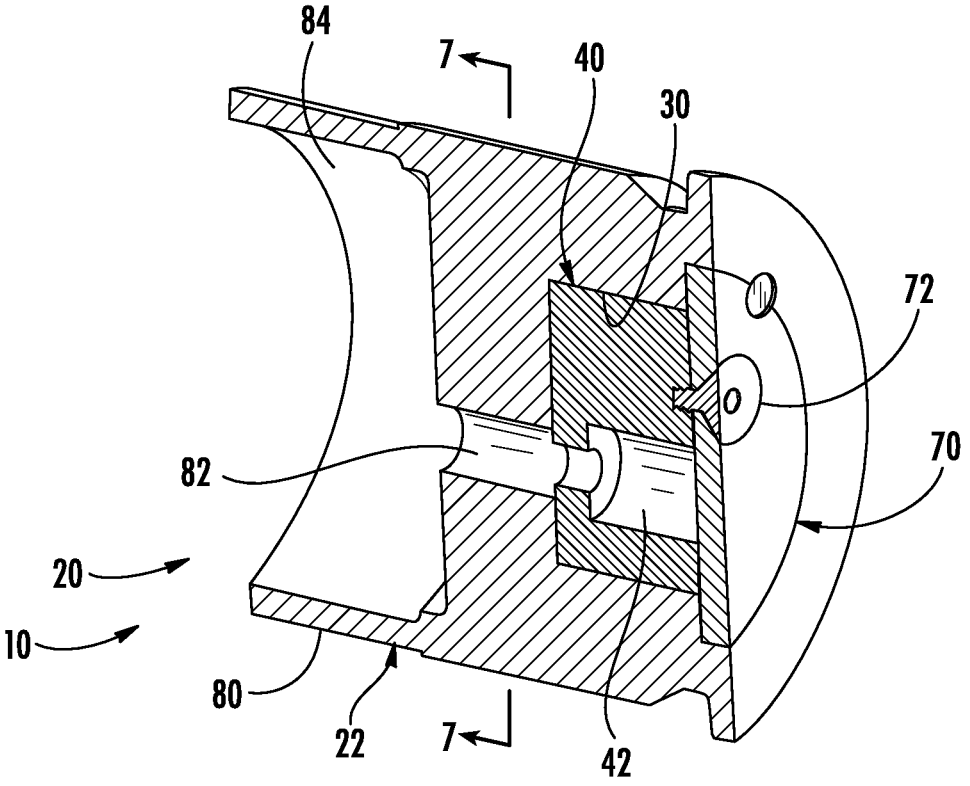
FIG. 5 is a sectional view of the propellant unit, taken generally along line 5-5 of FIG. 4.
Figure 6:
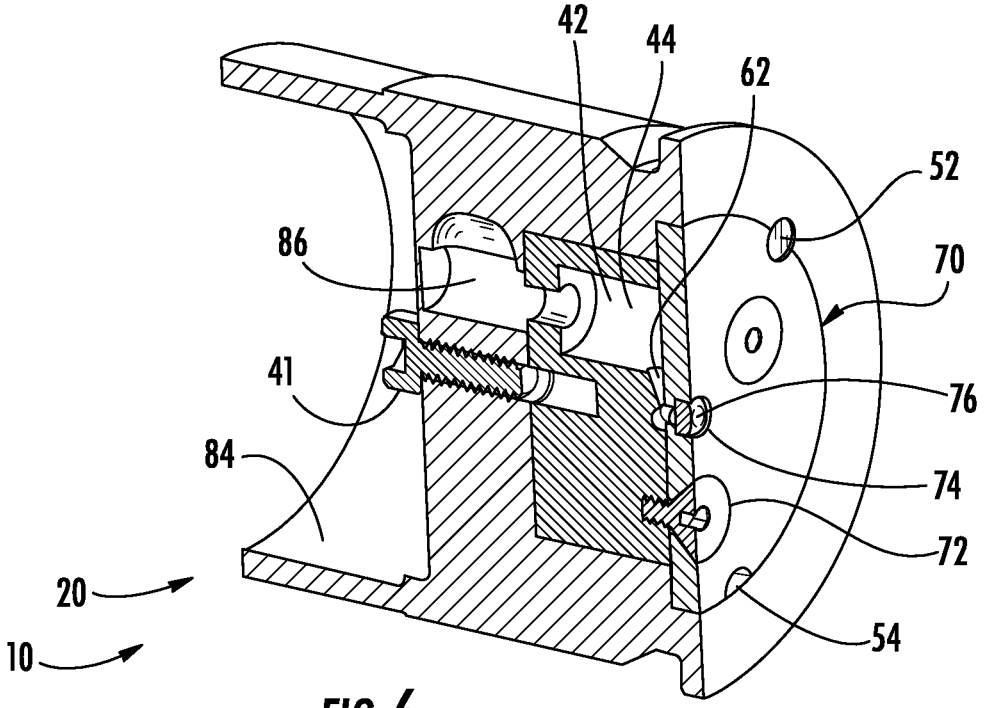
FIG. 6 is a sectional view through the centerline of the propellant unit, taken generally along line 6-6 of FIG. 4.
Figure 7:
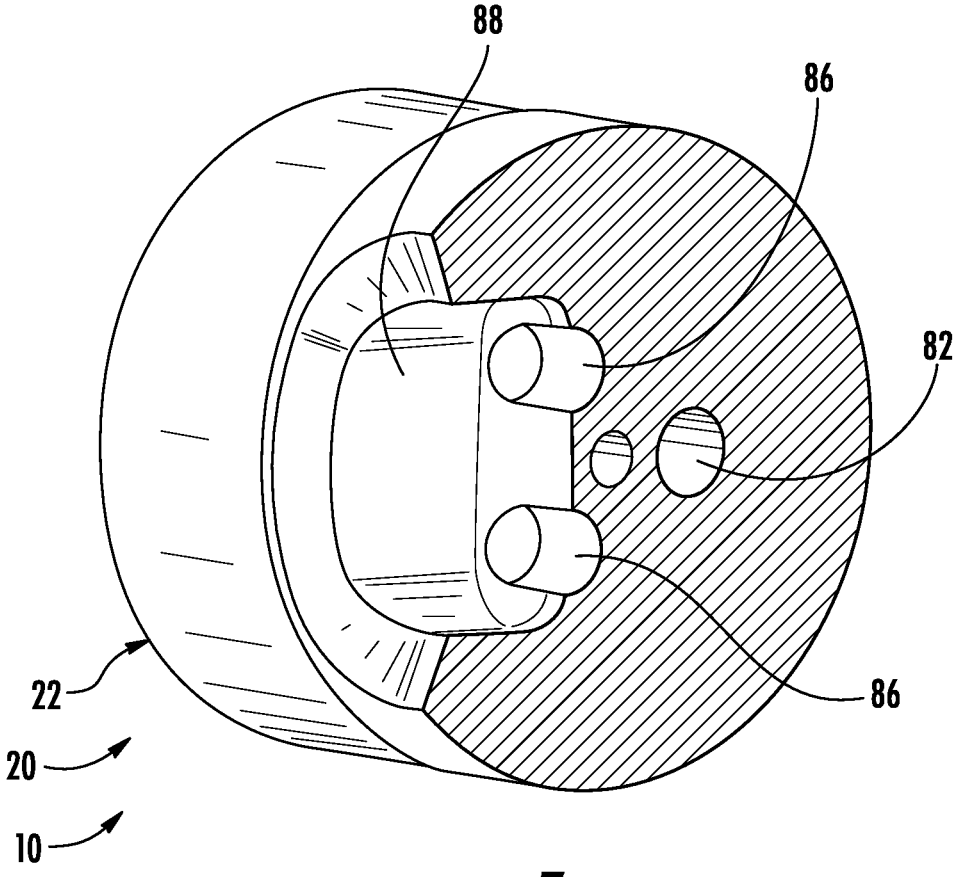
FIG. 7 is a perspective sectional view of the propellant unit, looking downstream.
Figure 8:
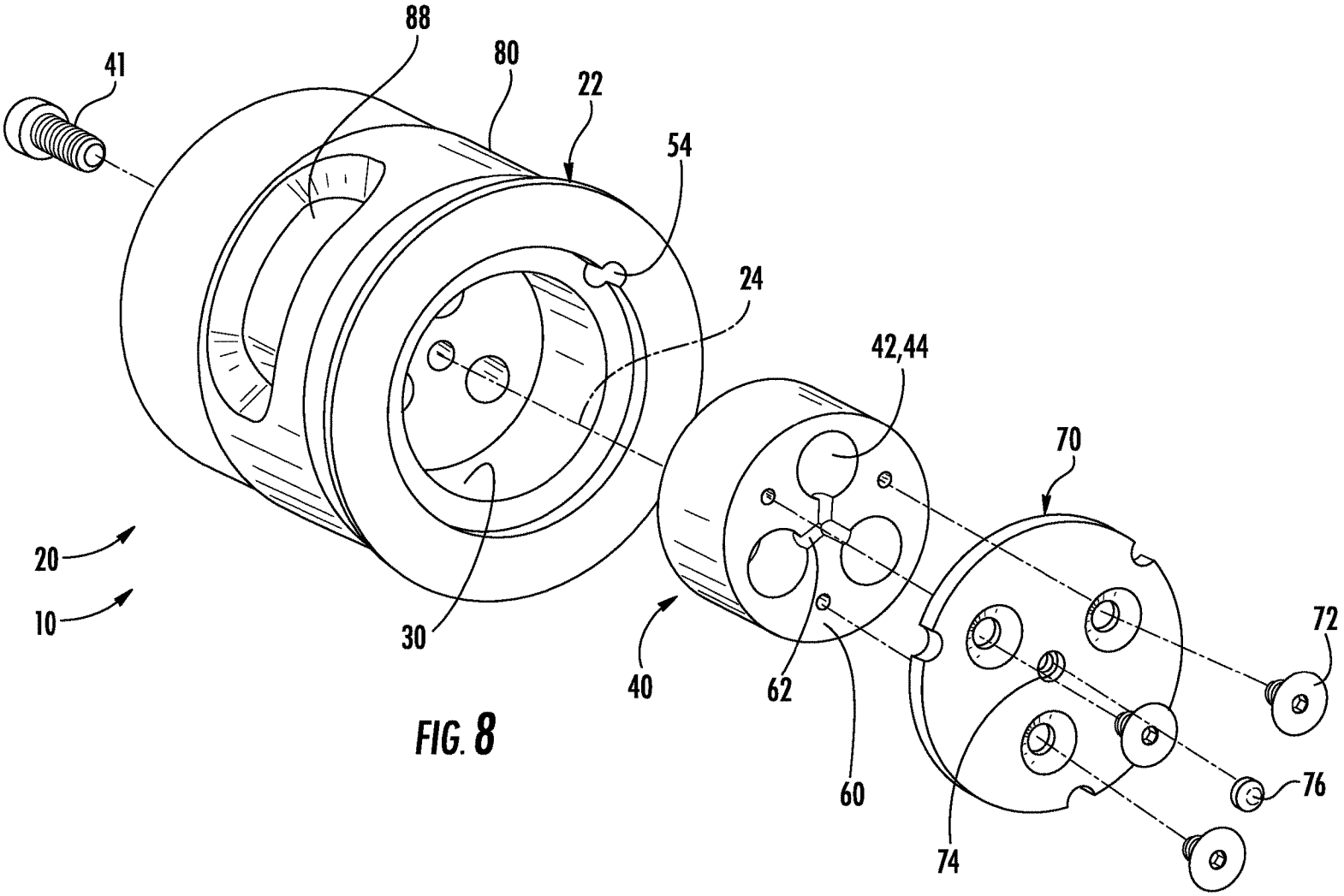
FIG. 8 is an exploded perspective view of the propellant unit.
Figure 9:
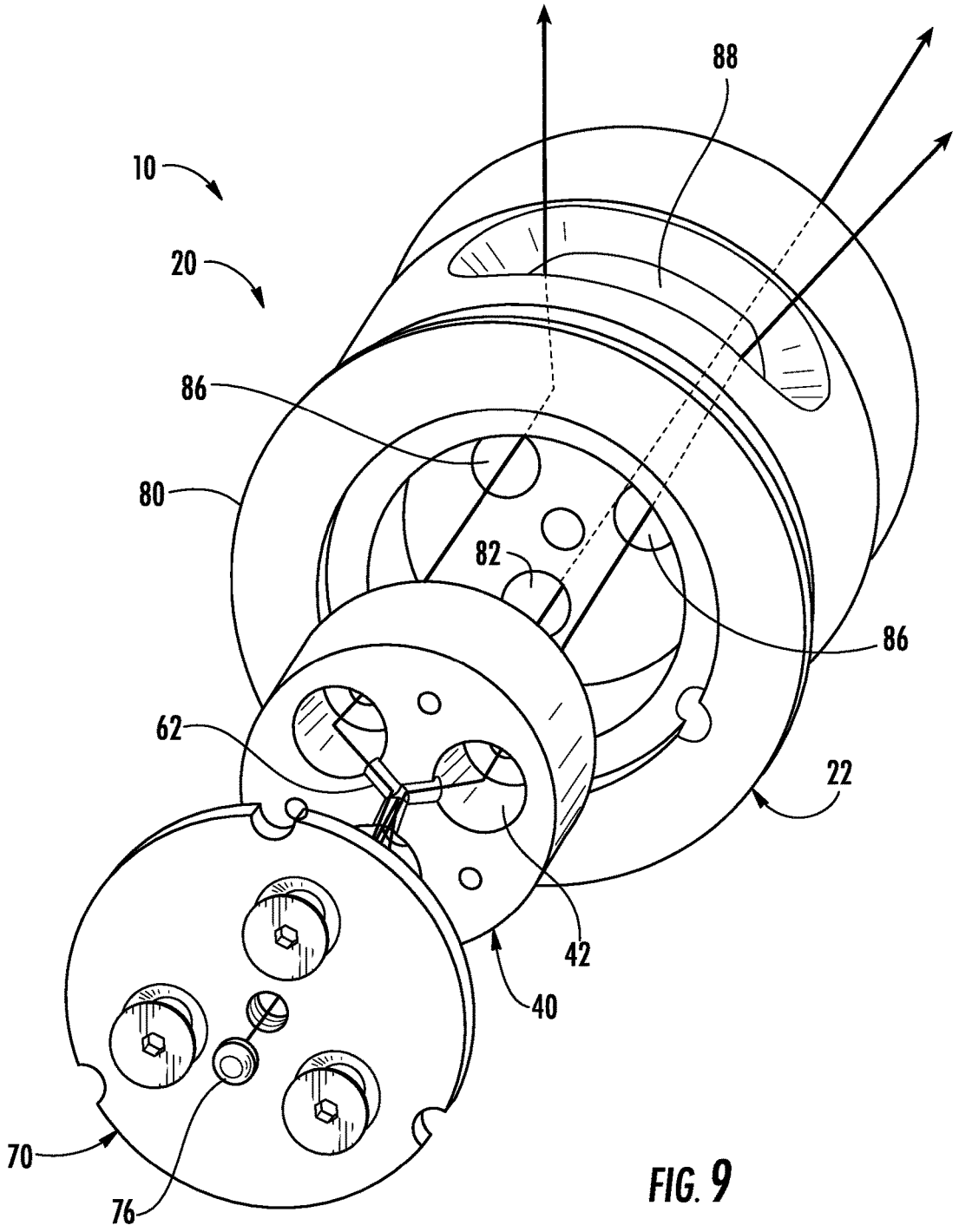
FIG. 9 is a schematic illustration of fluid flow paths in the propellant unit of FIG. 1 when actuated.

The cylinder 40 has within it a plurality of propellant chambers 42. The propellant chambers 42 are disposed in a circular array centered on the axis 34. The propellant chambers 42 extend axially to the downstream end surface of the cylinder 40, and may be necked down as shown in FIG. 5. In the illustrated embodiment, the cylinder 40 has three propellant chambers 42; other embodiments of the invention could have fewer of more propellant chambers.

The munition 10 when assembled includes one or more propellant charges 44. The propellant charges 44 may be preformed cartridges, of may be loaded as individual components into the propellant chambers of the cylinder. Each one of the propellant chambers 42 receives an individual propellant charge 44. The propellant unit 20 also includes a sealing ring (not shown) that acts as a gasket between the cylinder and the shell 22.

The cylinder 40 has a circular upstream end surface 60 (FIG. 8) on which there are formed multiple primer passages 62, one connected with each one of the propellant chambers 42. The primer passages 62 extend radially and axially from the center of the end surface 60 to the propellant chambers 42.

A circular end disk 70 is secured with several fasteners 72 to the upstream end surface 60 of the cylinder 40. The disk 70 has at it center a primer cavity 74 that receives a primer 76. The primer cavity 74 in the end disk 70 is in fluid communication with the primer passages 62 in the cylinder 40. The primer 76 is ignitable so as to ignite the propellant charges 44 in the cylinder 40, as described below in detail.

The propellant unit 20 also includes an index assembly 50. The index assembly 50 (FIG. 3) includes a small pin 52 supported on the shell and located on the circumference of the cylinder 40, and a compression spring (not shown) located axially behind the pin. The pin 52 is engageable in a selected notch 54 on the outer periphery of the end disk 70. There is one notch for each propellant chamber 42. The index assembly 50 provides a means to lock or maintain the rotational position of the cylinder 40 at selected index positions, or firing positions, within the shell 22.

The portion of the shell 22 that is downstream of the cylinder chamber is formed as a manifold 80. The manifold 80 includes one through passage 82 (FIGS. 2, 4, 5, and 9) that extends from the downstream end of the cylinder 40 to a projectile chamber 84 at the downstream end of the manifold. The through passage 82 is circumferentially and radially positioned so that when the cylinder 40 is in one of the index positions, one and only one of the propellant chambers 42 opens directly into the through passage.

The manifold 80 also includes vent passages 86 (FIGS. 2, 6, 7, and 9) that extend from the downstream end of the cylinder 40 to a vent chamber 88 in the manifold. There is one vent passage 86 for each non-selected propellant chamber 42, and so in the illustrated embodiment there are two vent passages 86 that extend from the downstream end of the cylinder 40 of the vent chamber 88. The vent chamber 88 opens on the radially outer side surface of the manifold 80, upstream of the projectile 12. The two vent passages 86 are circumferentially and radially positioned so that when the cylinder 40 is in one of the index or firing positions, the two non-selected propellant chambers 42 open directly into the vent passages.

When the cylinder 40 is rotated within the shell 22 and stops in a selected index position, the selected propellant chamber 42 is centered on the through passage 82 and is thus in a position to direct combustion products against the projectile 12. To change the munition 10 to a different propellant, the operator depresses and holds in the index pin 52, pushing axially in a direction to the left as viewed in FIG. 3, using a small screwdriver or similar tool. With the pin 52 depressed, the cylinder 40 can be rotated around the axis. Once this rotation starts, the index pin 52 no longer needs to be held in, because the geometry of the parts keeps the spring compressed until the next notch 54 is reached. Once the selected alignment is achieved, the index pin 52 pops into position, centering the desired propellant charge 44 on the through passage 82.

In operation of the munition 10, the primer charge 76 is activated by a firing pin or the like. The combustion products of the primer charge 76 flow through the primer passage 62 to the three propellant chambers 42. As a result, all three propellant charges 44 are ignited simultaneously.

The combustion products of the selected propellant charge 44 flow out of its propellant chamber 42 and into the through passage 82 in the manifold 80. Those combustion products engage the projectile 12, causing the projectile to be ejected from the shell 22 as desired.

The combustion products of the other two (non-selected) propellant charges 44 do not flow into contact with the projectile 12. Rather, they flow through the vent passages 86 in the manifold 80 and into the vent chamber 88, from where they are vented through the barrel of the launcher.

Thus, in accordance with the invention, a single ignition sequence ignites all three propellant charges 44, but the combustion products of only one of the three charges are used to propel the projectile 12. The combustion products of the other two propellant charges 44 are vented. As a result, no unexploded ordnance remains in the munition 10 after firing of the projectile 12, even though only one charge 44 is used to propel the projectile.

Figure 10:
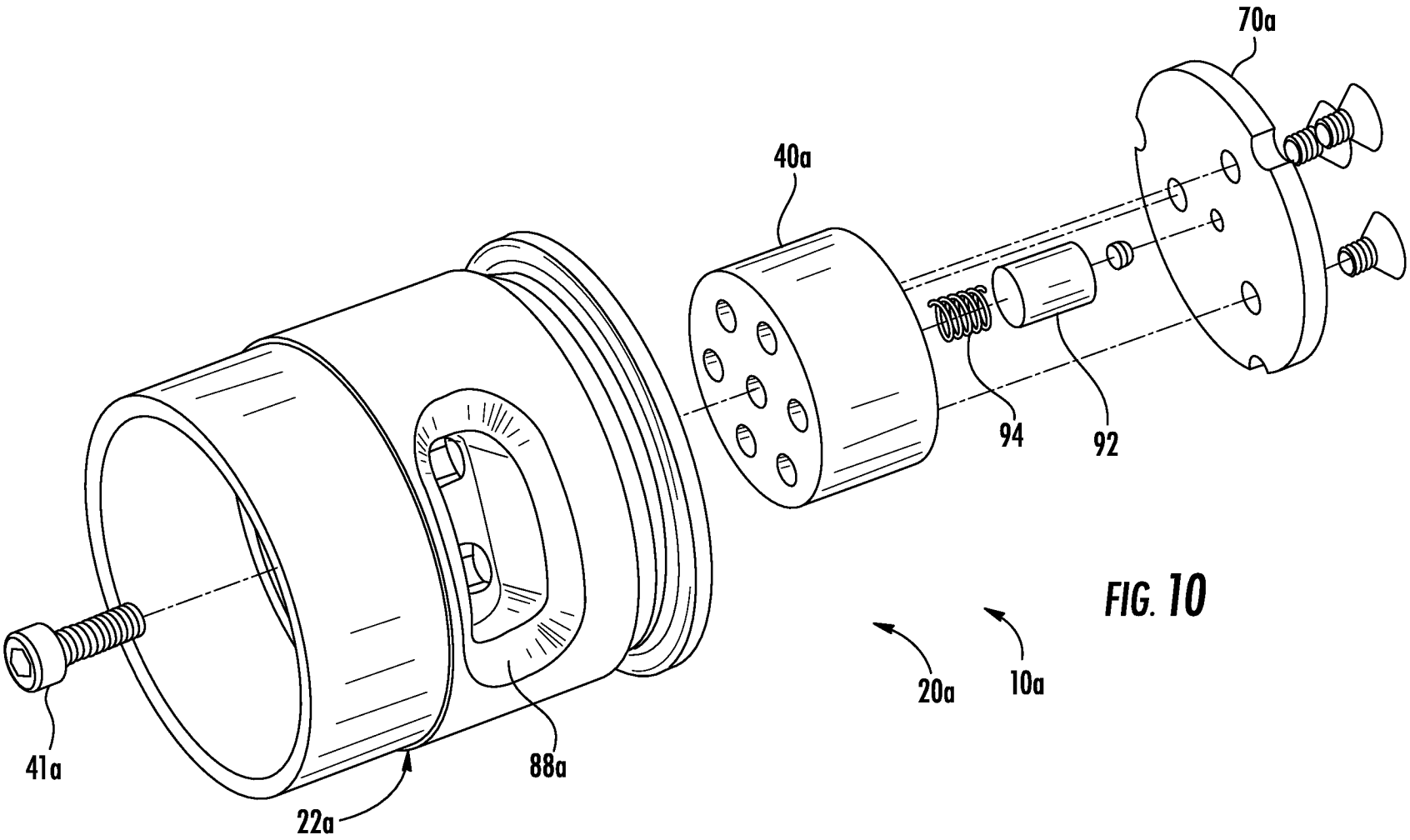
FIG. 10 is an exploded perspective view of a propellant unit that is a second embodiment of the invention.
Figure 11:
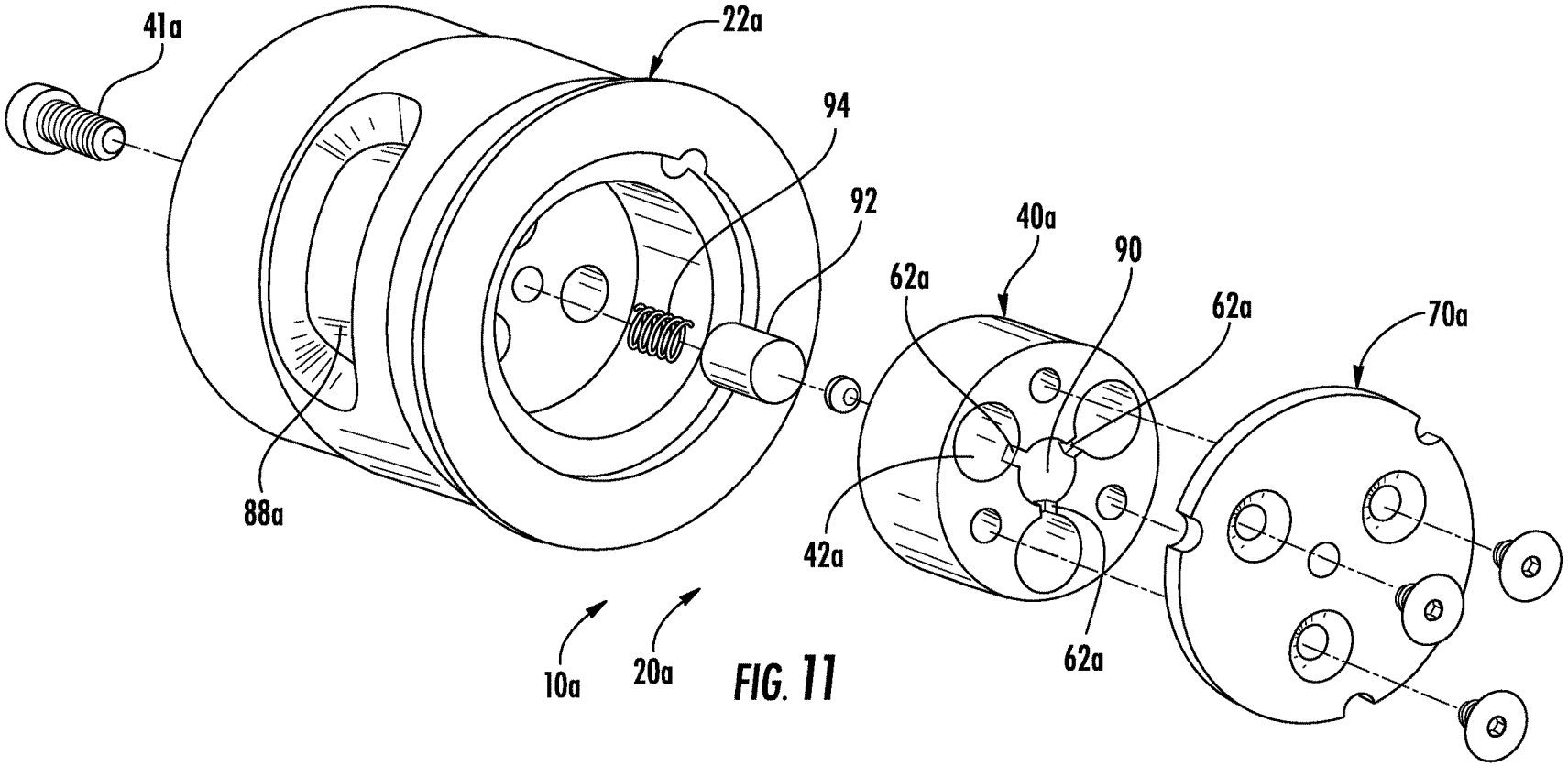
FIG. 11 is another exploded perspective view of the propellant unit of FIG. 10.

FIGS. 10 and 11 illustrate a propellant unit 20*a* that is a second embodiment of the invention. The propellant unit 20*a* is generally similar in construction to the propellant unit 20, and like parts are given the same reference numerals with the suffix "a" attached to distinguish them.

In the propellant unit 20*a*, the cylinder 40*a* has a well 90 (FIG. 11) on its upstream end that opens to the radially inner ends of the primer passages 62*a*. A plug 92 is disposed in the well 90. The plug 92 is biased in a direction toward the end disk 70*a* (to the right as viewed in the drawings) by a compression spring 94 disposed in the well 90, behind the plug (to the left as viewed in FIGS. 10 and 11). The spring 94 has enough biasing force to normally urge the plug 92 into engagement with the end disk 70*a*, and thus close off the primer passages 62*a* that are located in the cylinder 40*a*. The force of the combustion products of the primer can, however, overcome the biasing force of the spring 94 and move the plug 92 toward the projectile, so as to uncover the primer passages 62*a*.

The plug 92 limits the ability of combustion products of the non-selected propellant charges 44*a* to intermingle with (supplement) the combustion products of the selected propellant charge 44*a*. This issue might arise because all the propellant chambers 42 are connected in fluid communication with each other by the primer passages 62*a*. This problem is minimized by closing off the primer passages 62*a* as soon as possible during the ignition sequence.

Specifically, when the primer is ignited, the force of the combustion products of the primer overcomes the biasing force of the spring 94 and moves the plug 92 toward the projectile. This movement of the plug 92 away from the end disk 70*a* uncovers the primer passages 62*a*, and the combustion products of the primer are allowed to flow through the primer passages into the propellant chambers 42*a*. All the propellant charges 44*a* ignite and generate combustion products.

After the combustion products of the primer have flowed into the propellant chambers 44*a*, there is no axially directed force on the plug 92 (form the primer combustion products) that would overcome the biasing force of the spring 94. The biasing force of the spring 94 urges the plug 92 back to its starting position, and in this position, the plug again blocks off the primer passages 62*a*. As a result, combustion products from the non-selected propellant chambers 42*a* cannot backflow into the selected propellant chamber.

In one aspect, the invention is a munition receivable in a chamber of a projectile launcher, the munition comprising a projectile and a propellant unit that is actuatable to produce gas under pressure. The projectile is releasably connected with the propellant unit and receives force of the gas under pressure to cause the projectile to release from the propellant unit and travel from the launcher toward a target. The propellant unit comprises a shell; a cylinder selectively rotatable in the shell between a plurality of firing positions; the cylinder having at least two propellant chambers each receiving a respective propellant charge; a primer mechanism for igniting all of the propellant charges in the cylinder; the shell having a first passage for directing combustion products of a selected one of the propellant charges to the projectile and having a second passage for venting combustion products of all non-selected propellant charges.

In another aspect, the invention includes an index assembly acting between the cylinder and the shell for holding the cylinder in a selected firing position in the shell.

In another aspect, the propellant chamber of the selected one of the propellant charges is in fluid communication with the first passage and the propellant chambers of all non-selected propellant charges are in fluid communication with the second passage, when the cylinder is in the selected firing position.

In another aspect, the portion of the shell that is downstream of the cylinder chamber is formed as a manifold that includes one through passage that extends from the downstream end of the cylinder to a projectile chamber and that is circumferentially and radially positioned so that when the cylinder is in the selected firing position one and only one of the propellant chambers opens into the through passage, the through passage constituting the first passage.

In another aspect, the second passage comprises a plurality of vent passages in the manifold that extend from the downstream end of the non-selected propellant chambers to a vent chamber in the manifold, the vent chamber opening on the radially outer side surface of the manifold, upstream of the projectile.

In another aspect, the primer mechanism includes a primer in a primer cavity and a plurality of flow passages directing combustion products of the primer from the primer cavity to all of the propellant charges to ignite all of the propellant charges in the cylinder.

In another aspect, the cylinder has an upstream end surface on which the flow passages are formed.

In another aspect, the munition includes a movable member in the cylinder that is selectively movable between a first position that allows flow of combustion products from the primer to the propellant chambers to ignite the propellant charges and a second position that blocks flow of combustion products between the propellant chambers after the propellant charges are ignited.

In another aspect, the movable member is biased to the second position and is moved from the second position to the first position under the influence of the force of the combustion products of the primer.

In one aspect, the invention is a munition receivable in a chamber of a projectile launcher, comprising a projectile and a propellant unit that is actuatable to produce gas under pressure. The projectile is releasably connected with the propellant unit and receives force of the gas under pressure to cause the projectile to release from the propellant unit and travel from the launcher toward a target. The propellant unit comprises a shell; a propellant insert in the shell and having at least two propellant chambers each receiving a respective propellant charge; a primer mechanism for igniting all of the propellant charges in the propellant insert; and the shell having a first passage for directing combustion products of a selected one of the propellant charges to the projectile and having a second passage for venting combustion products of all non-selected propellant charges.

In another aspect, the propellant insert is a cylinder rotatably supported in the shell between a plurality of firing positions, and the munition includes an index assembly acting between the cylinder and the shell for holding the cylinder in a selected firing position in the shell.

In another aspect, the propellant chamber of the selected one of the propellant charges is in fluid communication with the projectile and the propellant chambers of all non-selected propellant charges are in fluid communication with a vent chamber when the cylinder is in the selected firing position In another aspect, the primer mechanism includes a primer in a primer cavity and a plurality of flow passages directing combustion products of the primer to all of the propellant charges to ignite all of the propellant charges in the propellant insert.

From the foregoing description, those skilled in the art will perceive improvements, changes, and modifications in the invention. Such improvements, changes, and modifications within the skill of the art are intended to be covered by the appended claims.

The invention claimed is:

1. A munition receivable in a chamber of a projectile launcher, the munition comprising:

a projectile; and a propellant unit that is actuatable to produce gas under pressure, the projectile being releasably connected with the propellant unit and receiving force of the gas under pressure to cause the projectile to release from the propellant unit and travel from the launcher toward a target, the propellant unit comprising:

a shell;

a cylinder selectively rotatable in the shell between a plurality of firing positions;

the cylinder having at least two propellant chambers each receiving a respective propellant charge;

a primer mechanism for igniting all of the propellant charges in the cylinder;

the shell having a first passage for directing combustion products of a selected one of the propellant charges to the projectile and having a second passage for venting combustion products of all non-selected propellant charges.

2. A munition as set forth in claim 1 further comprising an index assembly acting between the cylinder and the shell for holding the cylinder in a selected firing position in the shell.

3. A munition as set forth in claim 2 wherein the propellant chamber of the selected one of the propellant charges is in fluid communication with the first passage and the propellant chambers of all non-selected propellant charges are in fluid communication with the second passage, when the cylinder is in the selected firing position.

4. A munition as set forth in claim 2 wherein the portion of the shell that is downstream of the cylinder chamber is formed as a manifold that includes one through passage that extends from the downstream end of the cylinder to a projectile chamber and that is circumferentially and radially positioned so that when the cylinder is in the selected firing position one and only one of the propellant chambers opens into the through passage, the through passage constituting the first passage.

5. A munition as set forth in claim 4 wherein the second passage comprises a plurality of vent passages in the manifold that extend from the downstream end of the non-selected propellant chambers to a vent chamber in the manifold, the vent chamber opening on the radially outer side surface of the manifold, upstream of the projectile.

6. A munition as set forth in claim 1 wherein the primer mechanism includes a primer in a primer cavity and a plurality of flow passages directing combustion products of the primer from the primer cavity to all of the propellant charges to ignite all of the propellant charges in the cylinder.

7. A munition as set forth in claim 6 wherein the cylinder has an upstream end surface on which the flow passages are formed.

8. A munition as set forth in claim 1 including a movable member in the cylinder that is selectively movable between a first position that allows flow of combustion products from the primer to the propellant chambers to ignite the propellant charges and a second position that blocks flow of combustion products between the propellant chambers after the propellant charges are ignited.

9. A munition as set forth in claim 8 wherein the movable member is biased to the second position and is moved from the second position to the first position under the influence of the force of the combustion products of the primer.

10. A munition receivable in a chamber of a projectile launcher, the munition comprising:

a projectile; and a propellant unit that is actuatable to produce gas under pressure, the projectile being releasably connected with the propellant unit and receiving force of the gas under pressure to cause the projectile to release from the propellant unit and travel from the launcher toward a target, the propellant unit comprising:

a shell;

a propellant insert in the shell and having at least two propellant chambers each receiving a respective propellant charge;

a primer mechanism for igniting all of the propellant charges in the propellant insert; and the shell having a first passage for directing combustion products of a selected one of the propellant charges to the projectile and having a second passage for venting combustion products of all non-selected propellant charges;

wherein the propellant insert is a cylinder rotatably supported in the shell between a plurality of firing positions, and wherein the munition includes an index assembly acting between the cylinder and the shell for holding the cylinder in a selected firing position in the shell.

11. A munition as set forth in claim 10 wherein the propellant chamber of the selected one of the propellant charges is in fluid communication with the projectile and the propellant chambers of all non-selected propellant charges are in fluid communication with a vent chamber when the cylinder is in the selected firing position.

12. A munition as set forth in claim 10 wherein the primer mechanism includes a primer in a primer cavity and a plurality of flow passages directing combustion products of the primer to all of the propellant charges to ignite all of the propellant charges in the propellant insert.

* * * * *